US008066473B1

(12) United States Patent
Aho, Jr.

(10) Patent No.: US 8,066,473 B1
(45) Date of Patent: Nov. 29, 2011

(54) FLOATING AIR SEAL FOR A TURBINE

(75) Inventor: Wilho V Aho, Jr., West Palm Beach, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 449 days.

(21) Appl. No.: 12/418,786

(22) Filed: Apr. 6, 2009

(51) Int. Cl.
*F04D 11/02* (2006.01)

(52) U.S. Cl. ..... 415/112

(58) Field of Classification Search ..... 415/110–113, 415/174.1–174.3, 173.7, 115; 416/96 R, 416/97 R
See application file for complete search history.

(56) References Cited

U.S. PATENT DOCUMENTS 6,318,958 B1 * 11/2001 Giesler et al. ..... 415/112
6,330,780 B1 * 12/2001 Shipway ..... 53/426
6,623,238 B2 * 9/2003 Langston et al. ..... 415/112

* cited by examiner

*Primary Examiner* — Gary F. Paumen
(74) *Attorney, Agent, or Firm* — John Ryznic

(57) ABSTRACT

A gas turbine engine with a floating air seal to form a seal between a rotor disk and an adjacent stator vane segment shroud and allow for both axial and radial shifting of the rotor disk with respect to the stator while maintaining the sealing capability. The floating air seal includes an annular piston that slides within an annular groove formed within the stator in an axial direction. The annular piston includes an annular groove on the rotor disk side to form an air cushion against the rotor disk, a pressure buffer surface on the opposite end, and a central passage to supply the air cushion chamber with pressurized fluid from the buffer pressure chamber. A balancing force on the annular piston is formed between the air cushion formed and the pressure force acting to push the annular piston toward the rotor surface. The pressurized air used to form the floating air seal is also supplied to internal cooling air passages of the turbine blades through passages formed within the rotor disk or by a cover plate attached on the rotor disk side.

17 Claims, 7 Drawing Sheets

FLOATING AIR SEAL FOR A TURBINE

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a seal for a rotor disk in a gas turbine engine.

2. Description of the Related Art Including Information Disclosed Under 37 CFR 1.97 and 1.98

A gas turbine engine, such as an industrial gas turbine engine, includes a compressor to deliver compressed air to a combustor that produces a hot gas flow that is then passed through a turbine to produce mechanical power. The turbine includes a number of stages or rows of rotor blades and stator vanes that form a hot gas path through the turbine. The rotor blades form a seal with a stationary part of the engine to limit egress of the hot gas flow into parts of the engine that can be thermally damaged.

One prior art seal used in a gas turbine engine is where the rotor disk includes a labyrinth seal having a number of knife edges that rotates near to a surface on the stationary casing to form a rotary seal. The knife edge seal limits the leakage of flow but does not totally block the leakage. Brush seals are also used to reduce leakage. However, brush seals make contact with the rotating part and therefore cause wear of the brush bristles. Also, brush seals do not make good seals at high rotational speeds. One major problem with this type of rotary seal used in a gas turbine engine is that the gap formed between the rotary seal can vary depending upon the engine temperatures. During engine transients, the knife edges can actually rub against the stationary seal interface and thus cause heating or damaged to the knife edges. Some complex arrangement of parts have been proposed in the prior art to limit the seal gap in these types of rotary seals in gas turbine engines.

BRIEF SUMMARY OF THE INVENTION

It is an object of the present invention to provide for a rotary seal between a rotating part and a stationary part that will not increase the leakage across the seal due to thermal gradients within the turbo machine.

It is another object of the present invention to provide for a rotary seal between a rotating part and a stationary part that will block a secondary air flow from a primary gas path air flow in a turbo machine.

It is another object of the present invention to provide for a rotary seal between a rotating part and a stationary part that will allow for relative radial displacement of the seal forming surfaces without affecting the sealing ability.

It is another object of the present invention to provide for a rotary air seal between a rotor disk and a stationary vane that will also supply pressurized cooling air to the turbine blades of the rotor disk.

These objectives and more are achieved with the use of the rotary seal of the present invention that makes use of a floating seal that produces a cushion of film air between the rotating surface and the stationary surface that forms the seal interface between a rotor disk and the adjacent stator vane segments. The air cushion forms a seal that prevents any leakage from one side to the other side of the seal. Also, the seal surfaces are formed by an annular ring in which the sealing interface is parallel to a plane that is normal to the rotational axis of the turbo machine so that a radial displacement of the rotating seal part with respect to the stationary seal part will not affect the seal.

The sealing member is an annular ring with a central passage to pass pressurized air to form the cushion of film air on which the annular ring floats during operation. A forward side of the annular ring forms a surface area for the pressurized air to act that forces the annular ring against the stationary seal surface. Pressurized air passing through the axial holes in the annular ring forms a cushion of air for the floating seal that also prevent mixing of the outer fluid with the inner fluid in which the floating seal separates.

In one embodiment, the floating air seal also provides pressurized cooling air to the rotor blades on the rotor disk through cooling air passages formed within the rotor disk. In another embodiment, the pressurized cooling air from the floating air seal includes a stepped floating annular ring that supplies the cooling air to a space formed between the rotor disk and a cover plate.

DETAILED DESCRIPTION OF THE INVENTION

Figure 1:
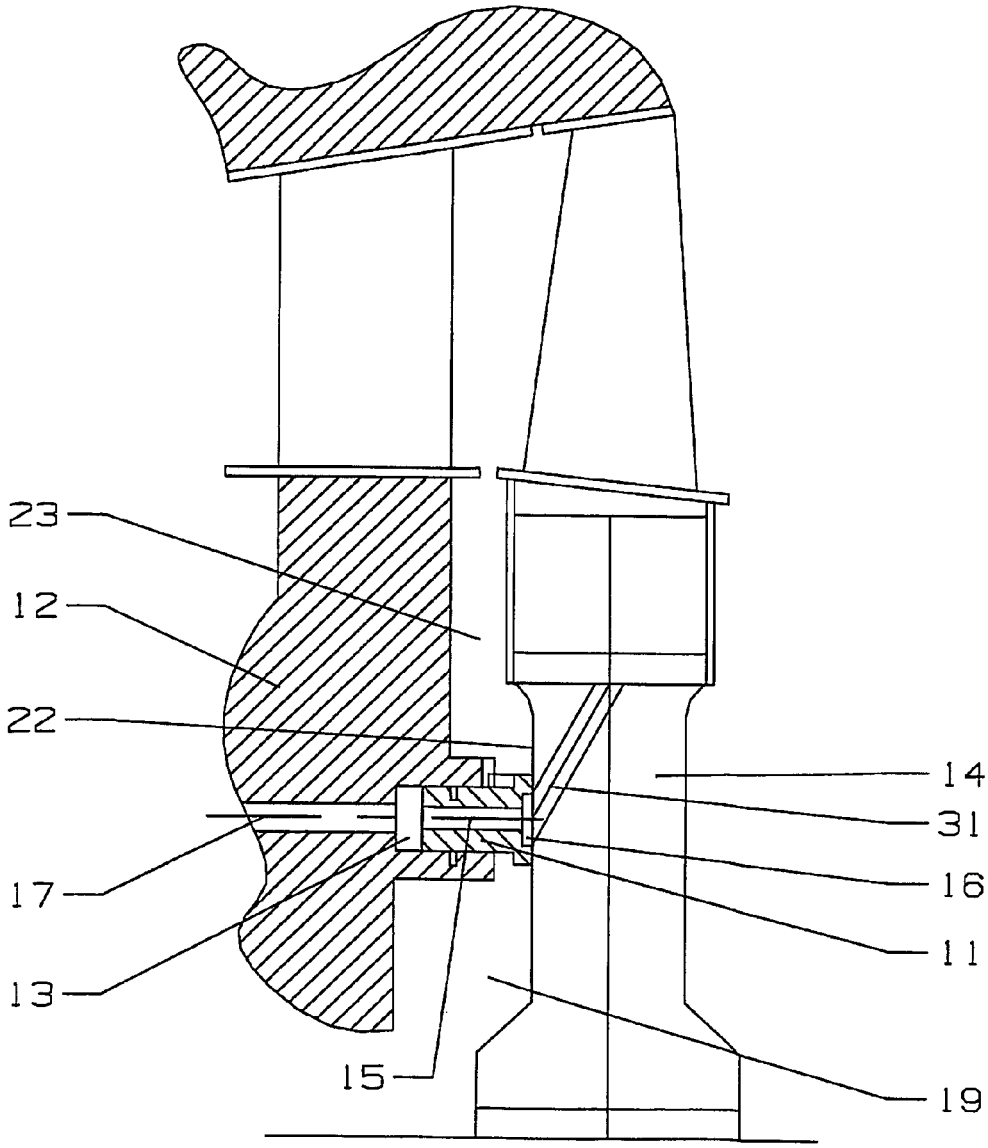
FIG. 1 shows a cross section view of a first embodiment of the floating air seal in the turbine rotor disk of the present invention.

The present invention is an air floating seal used in a gas turbine engine to form a seal between the rotor disk and the stator vane segments. The floating air seal is intended for use with an industrial gas turbine engine, but can also be used in an aero engine. FIG. 1 shows a cross section view of a rotor blade and stator vane stage in a gas turbine engine with the floating air seal forming a seal between the rotating rotor disk and the stationary stator vane segments. The stator vane inner shroud 12 extends from the vane airfoils that are secured to the engine casing at the outer shrouds. The stator vane shroud 12 forms a support surface for the floating air seal and include an annular groove 13 having an opening that faces the rotor disk 14. The annular groove forms a buffer pressure camber 13. The annular groove 13 is concentric with the rotational axis of the turbine. The annular groove is connected to a pressurized air source, such as the engine compressor, by one or more buffer passages 17.

Figure 5:
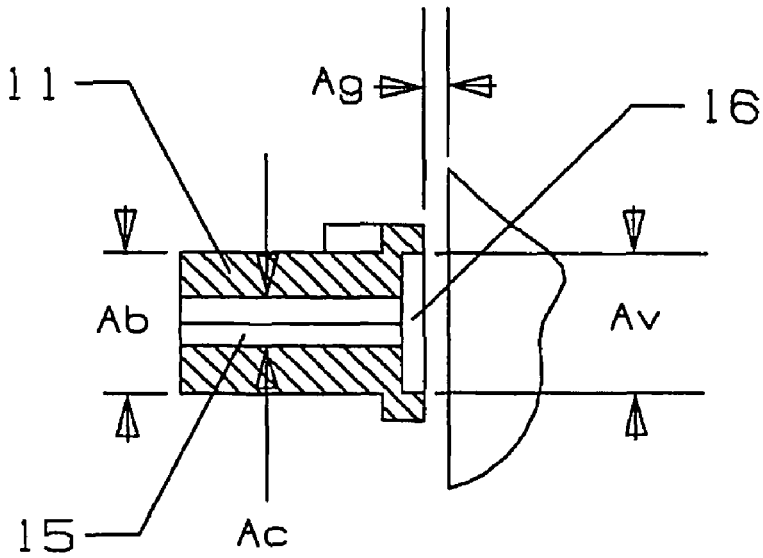
FIG. 5 shows a cross section detailed view of the floating annular piston that forms the floating seal.

The piston of the floating air seal 11 is shown in more detail in FIG. 5 with the different faces that form pressure reacting surfaces for producing the air cushion that forms the seal. The piston includes the central passage 15 having a diameter Ac, a rear face with a radial height Ab, and the cavity on the front face with a radial height of Av. A gap of length Ag is formed between the side walls of the cavity 16 on the front face of the piston and the surface 22 of the rotor disk 14. The area Av must be slightly larger than the area Ab to provide the lift off pressure to open the gap Ag. The seal pass-through central passage 15 area Ac is sized to provide the area Ag. The floating piston ring 11 and the annular groove 13 formed within the stator vane shroud 12 include an anti-rotation feature that will prevent rotation of the annular piston ring 11 within the annular groove 13 but will allow the axial displacement. In the present embodiment, a slot and key is used to allow axial displacement of the annular piston ring 11 while preventing rotation of the piston ring 11 with respect to the stator vane shroud 12. A key can be part of the annular piston ring 11 and a slot in which the key can slide in the axial direction of the piston ring will produce this function. Other anti-rotation designs can be used that will allow for the axial displacement but prevent rotation.

A fluid pressure, such as compressed air from the compressor of the engine, is applied to the buffer cavity 13 through the buffer passage 17 to produce a force acting on the rear face of the annular piston 11 to move the annular piston 11 forward toward the rotor disk surface 22. The pressure source also flows through the central passage 15 and into the cavity 16 to form an air cushion in the gap that will form. The air gap from the cushion and the net force acting on the rear face of the annular piston 11 will result in the floating air seal to prevent the hot gas flow passing through the turbine from mixing with the cooler air within the rim cavity between the rotor disk and the stator vane shroud. The floating air seal will prevent the pressure in the inner cavity 19 from leaking into the outer cavity 23. Or the outer cavity 23 from leaking into the inner cavity 19. Because the pressure in the buffer cavity from Pb being greater than the pressure in the inner cavity Pp and the pressure in the outer cavity Pa, the floating air seal 11 will maintain a small gap with an air cushion.

The pressurized air used to support the floating air seal is also used to supply the pressurized cooling air to the rotor blades. Cooling air supply passages 31 are formed within the rotor disk 14 to connect the buffer cavity 16 to the cooling passages formed within the rotor blades. The cooling air supply passages 31 open onto the rotor disk surface 22 that forms the surface for the floating air seal.

Figure 2:
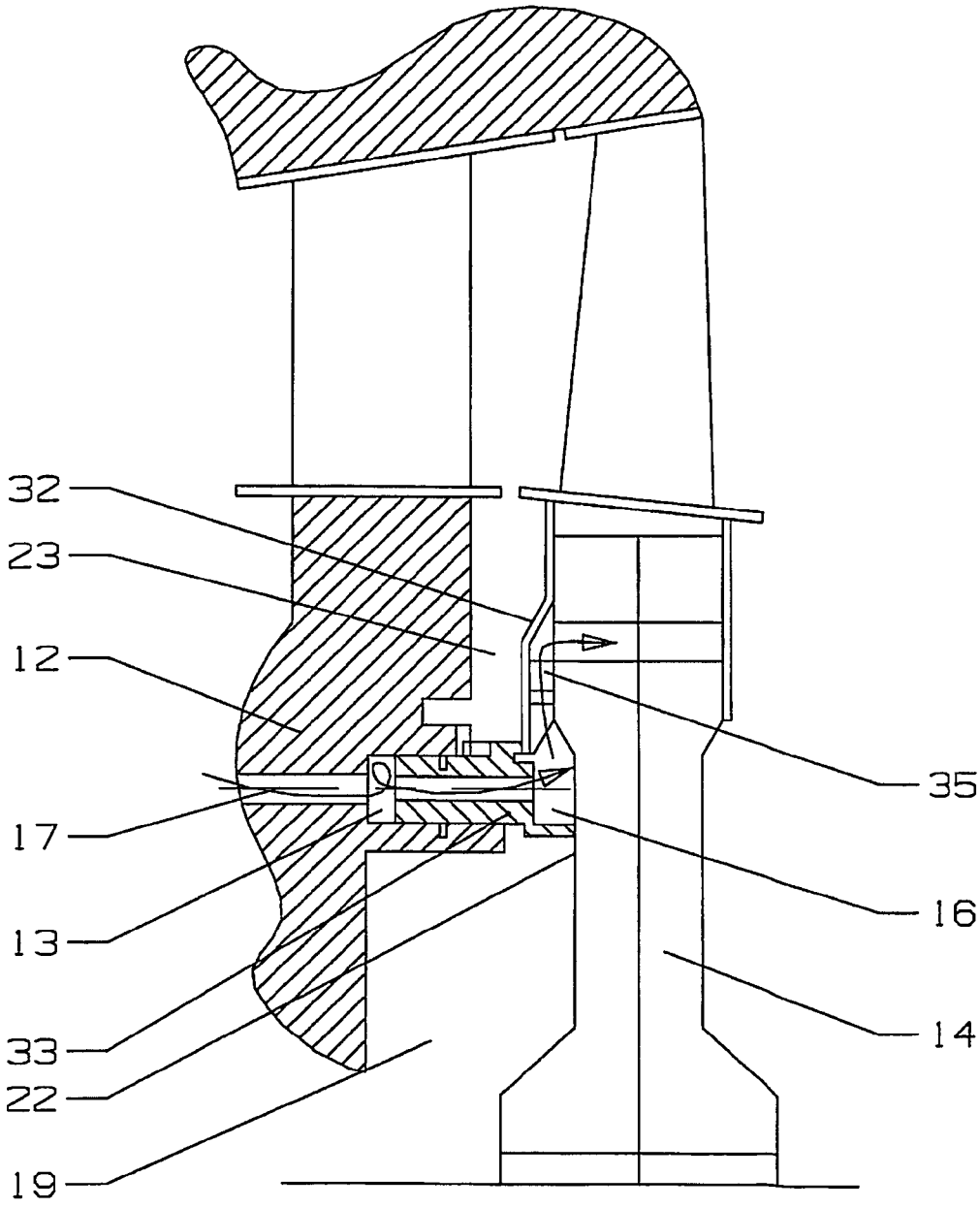
FIG. 2 shows a cross section view of a second embodiment of the floating air seal in the turbine rotor disk of the present invention.

In a second embodiment shown in FIG. 2, the annular piston 33 is a stepped annular piston with an inner ring floating over the rotor disk surface 22 as in the first embodiment, but with an outer ring stepped back to form a floating air gap with a cover plate 32 attached to the side of the rotor disk. The cover plate 32 forms a cooling air supply passage for the rotor blades on the rotor disk 14. The pressurized air that forms the floating air seal is also supplied to the internal cooling air passages of the rotor blades through the space formed between the cover plate 32 and the side of the rotor disk 14.

One of the main advantages of the present invention is that any radial displacement between the rotor 14 and the stator 12 and the floating air seal 11 will not affect the sealing capability. Since the air cushion is formed against the flat surface 22 on the rotor disk 14 and the flat surface 22 is perpendicular to the rotational axis of the floating air seal 11, any radial displacement will not affect the seal. Thus, the floating seal will make a better seal in a gas turbine engine than the prior art seal. In the prior art labyrinth seal typically used in a gas turbine engine, the lab seal will have a varying gap due to any radial displacement from temperature differences normal in the operation of a gas turbine engine. The lab seal can rub and remove material, or the gap can increase so that leakage flow across the seal is large. In the floating air seal of the present invention, the only leakage is the flow of Pb air passing through the gap Ag.

Figure 3:
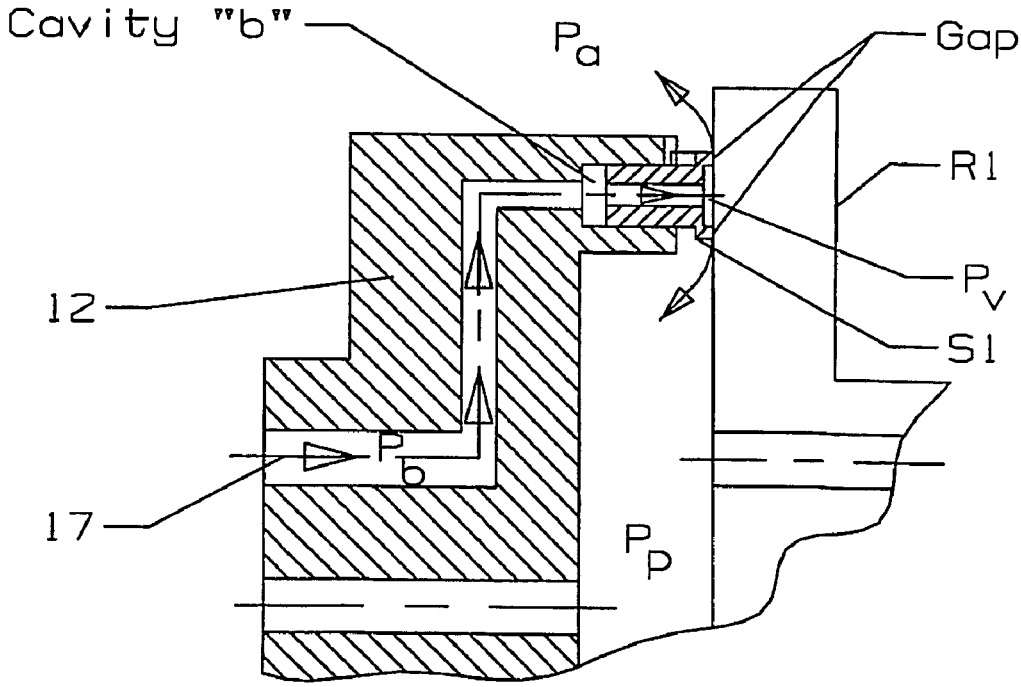
FIG. 3 shows a detailed cross section view of the floating air seal of the present invention.

When pressure Pb flows into the buffer cavity 13 and acts on the rear face of the annular piston 11, a force is produced that forces the annular piston 11 toward the rotor disk surface 22. The restriction formed by the central passage 15 allows for the fluid (air) to flow into the cavity 16 to form an air cushion in the gap between the annular piston 11 and the rotor disk surface 22. A balancing force between the pressure in the buffer cavity 13 and the seal cavity 16 will cause the floating air seal to lift off from the rotor disk surface 22 and maintain the appropriate gap to produce the seal. The fluid passing through the gap causes the pressure Pb in the buffer cavity 13 to force the seal back towards the rotor disk surface 22. This process stabilizes at a balance between the buffer cavity 13 pressure Pb, the restrictor flow, the seal cavity 16 pressure Pv and the gap flow. See FIG. 3.

Figure 9:
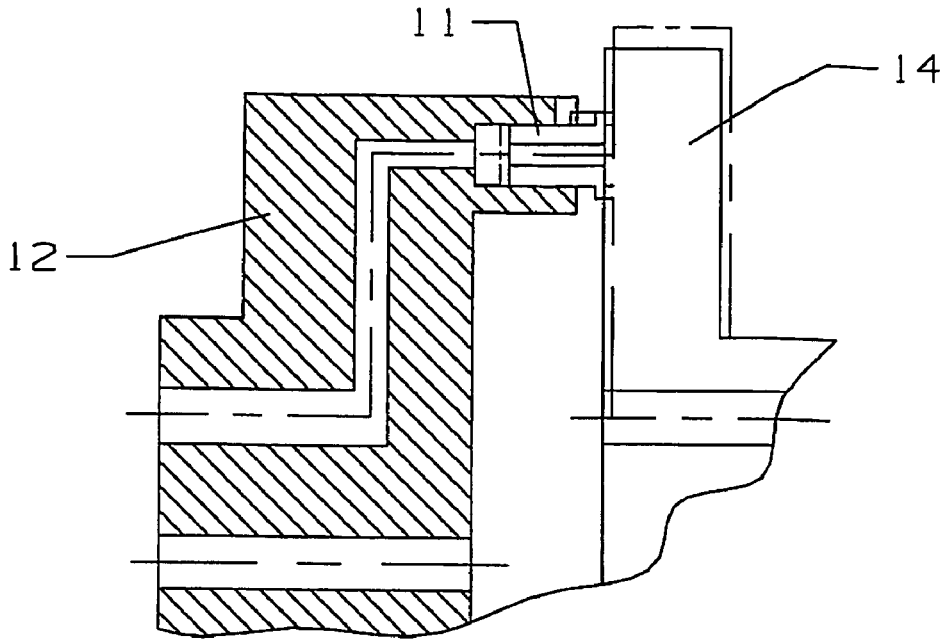
FIG. 9 shows a cross section view of the floating seal operating under thermal or rotor dynamic displacements.

FIG. 9 shows a depiction of the axial floating air seal of FIG. 1 with an axial and a radial displacement (represented by the dashed lines) of the rotor disk 14 with respect to the stationary stator vane segments 12 that holds the floating air seal annular piston 11. The floating air seal will maintain the close clearance even with these two displacements that would in the prior art seal cause rubbing or excess leakage around the seal interface. As the rotor disk 14 moves in both axial and radial directions, the annular piston 11 will move in an axial direction within the annular groove 13 to maintain the close clearance and thus tight seal.

Figure 4:
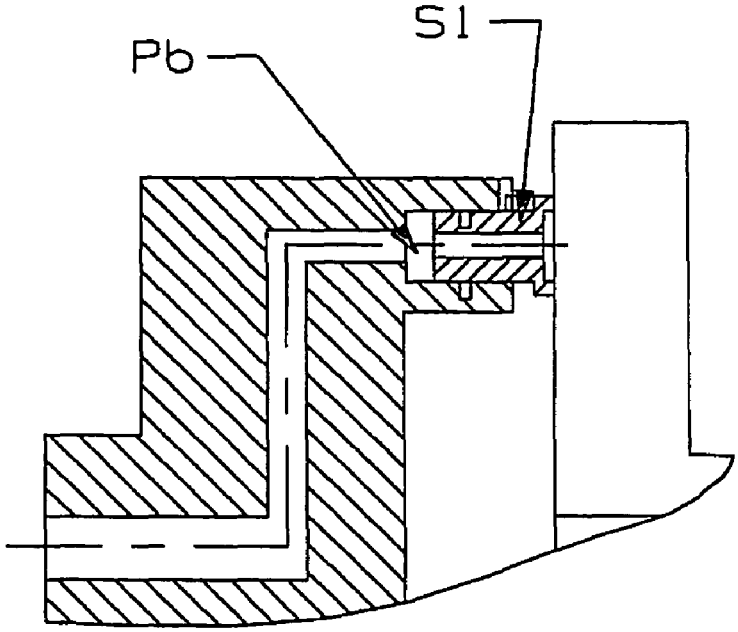
FIG. 4 shows a cross section detailed view of the floating air seal.

FIG. 4 shows the axial floating seal in which regulating of the pressure Pb serves to stiffen the position of the seal S1 and control the total flow through the gap Ag. In FIG. 5, the area Av must be slightly larger than Area Ab to provide lift off pressure to open the gap Ag. The seal pass-through area Ac of the central passage 15 is sized to provide the area Ag.

Figure 6:
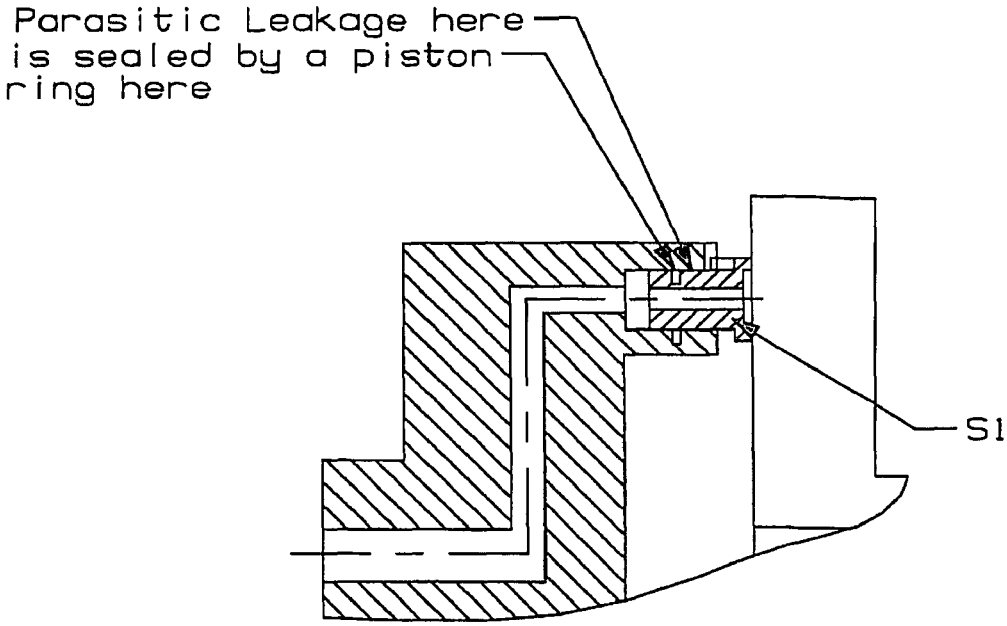
FIG. 6 shows a detailed cross section view of the annular piston with a seal to limit parasitic leakage.

FIG. 6 shows an embodiment of the axial floating seal with a piston ring or other metallic seal around the annular piston 11 to reduce the parasitic leakage across the annular piston 11. For lower temperature applications, an O-ring or other elastomeric or composite material configuration can be used instead of the piston ring.

Figure 7:
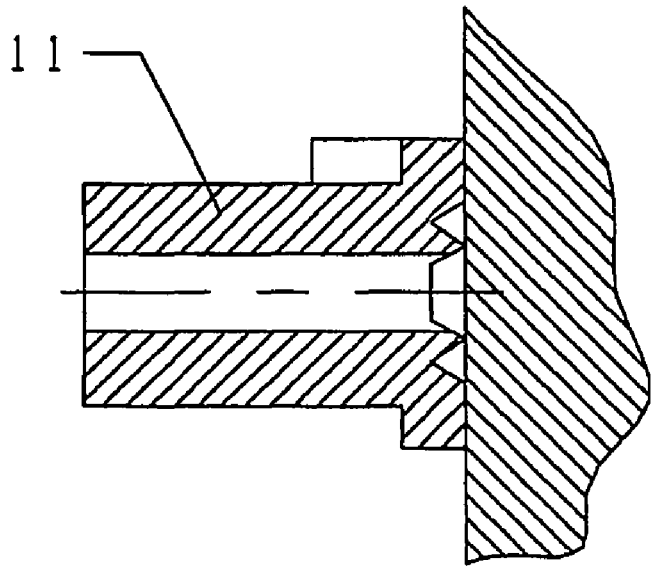
FIGS. 7 and 8 show additional embodiments of the annular piston with various gland configurations to provide damping capability from flow oscillations.
Figure 8:
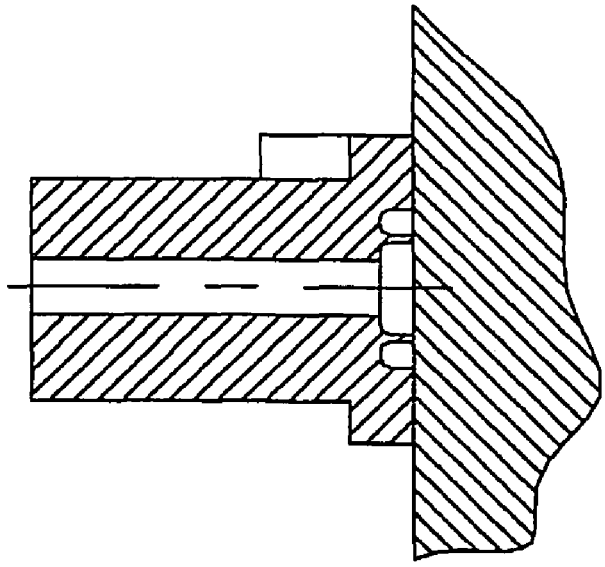

FIGS. 7 and 8 show alternate gland configurations for the annular piston 11 of the floating air seal in which the front face includes a number of cavities that function to dampen any possible flow oscillations during operation of the floating seal.

Figure 10:
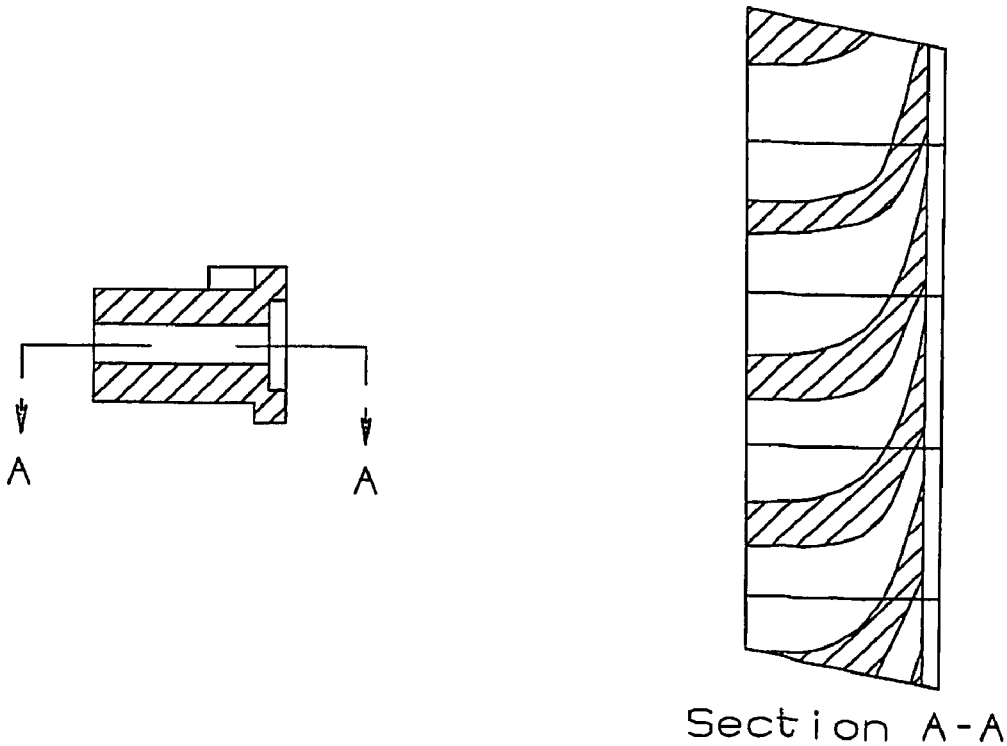
FIG. 10 shows a cross section view of the floating annular piston ring through a cut showing the pre-swirler.

FIG. 10 shows the annular piston ring 11 with pre-swirlers formed within the air passage to induce a pre-swirl motion to the pressurized air supplied to the adjacent rotor disk cooling air passage. The pre-swirler produces a swirl in the direction of rotation of the rotor disk so that the cooling air does not have to catch up to the rotating rotor disk. Producing a pre-swirling motion in the cooling air will reduce the pressure of the cooling air flowing through the rotor disk by around 50 degrees C. and produce an extra 1.4 MW is power output for an industrial gas turbine engine.

The axial floating air seal of the present invention has a number of benefits over the prior art labyrinth or brush seals. The axial floating air seal provides for a replacement for conventional knife edge seals or brush seals or carbon face seals in a gas turbine engine. The seal blocks the secondary air flow from the primary gas path of hot gas flow in the gas turbine engine. The seal blocks one secondary air flow from another secondary air flow in the engine. The seal blocks any lubricating or cooling oil or fuel from entering adjacent air chambers in applications such as bearing compartments in a gas turbine engine. Also, the axial floating air seal can be used in steam turbines and other turbo machinery such as a turbo pump. Other applications include an apparatus where fluids in two cavities must be isolated from each other and a buffer fluid intermixing with the fluids of each of the two cavities can be tolerated. Or, where fluids in two cavities must be isolated from each other and a buffer fluid intermixing with the fluids of each of the two cavities can be tolerated, with one or more of the enclosing cavity walls are moving or rotating with respect to the other cavity wall.

I claim the following:

1. A gas turbine engine comprising:

a rotor disk with a plurality of rotor blades secured to the rotor disk, the rotor disk having a floating air seal forming surface on a side of the rotor disk that is substantially perpendicular to a rotating axis of the rotor disk;

a stator vane with an inner shroud located adjacent to the rotor disk;

an annular groove formed within the stator vane inner shroud and opening toward the floating seal forming surface of the rotor disk;

an annular floating piston axially movable within the annular groove of the stator vane inner shroud;

the annular floating piston having an annular groove formed on a side facing the floating air seal forming surface of the rotor disk;

the annular floating piston having a fluid pressure reacting surface on an opposite side to the annular groove; and, the annular floating piston having a fluid passage connecting the fluid pressure reacting surface to the annular groove to supply a fluid pressure and form a fluid cushion for the floating air seal.

2. The gas turbine engine of claim 1, and further comprising:

an area of the annular groove of the annular floating piston is slightly greater than an area of the fluid pressure reacting surface in order to provide a liftoff pressure to open a gap formed between the annular floating piston and the floating seal forming surface on the rotor.

3. The gas turbine engine of claim 1, and further comprising:

the fluid passage in the annular floating piston is parallel to the floating piston axis.

4. The gas turbine engine of claim 1, and further comprising:

the annular floating piston and the rotor and the stator form an inner cavity sealed from a hot gas flow path through the turbine by the annular floating piston.

5. The gas turbine engine of claim 1, and further comprising:

the annular floating piston and the annular cavity form a buffer pressure chamber on a side of the annular floating piston opposite of the annular groove.

6. The gas turbine engine of claim 4, and further comprising:

the annular floating piston and the annular cavity form a buffer pressure chamber on a side of the annular floating piston opposite of the annular groove; and, the inner cavity and the buffer pressure chamber are at the same pressure during operation of the floating air seal.

7. The gas turbine engine of claim 1, and further comprising:

the floating air seal is a compressible fluid seal.

8. The gas turbine engine of claim 1, and further comprising:

the annular groove on the annular floating piston and the floating seal forming surface on the rotor are configured to allow for the floating air seal to maintain a seal between the annular floating piston and the rotor during axial and radial shifting of the rotor relative to the stationary stator.

9. The gas turbine engine of claim 1, and further comprising:

a seal ring between the annular floating piston and the annular groove to limit parasitic leakage.

10. The gas turbine engine of claim 1, and further comprising:

the floating piston includes glands that form the annular groove.

11. The gas turbine engine of claim 1, and further comprising:

the rotor blades include internal cooling air passages to provide cooling for the blades; and, means to connect the floating air seal to the internal cooling air passages to supply cooling air to the blades.

12. The gas turbine engine of claim 11, and further comprising:

the means to connect the floating air seal to the internal cooling air passages include a cooling air passage formed within the rotor disk and opening onto the rotor disk side surface adjacent to the buffer cavity of the annular piston.

13. The gas turbine engine of claim 11, and further comprising:

the means to connect the floating air seal to the internal cooling air passages include a cover plate secured to the rotor disk that forms a cooling air passage.

14. The gas turbine engine of claim 13, and further comprising:

the annular piston is a stepped annular piston with one rail floating over the rotor disk side surface and the other rail floating over the cover plate side surface.

15. The gas turbine engine of claim 11, and further comprising:

the source of pressurized air form the floating air seal is the compressor of the engine.

16. The gas turbine engine of claim 11, and further comprising:

The annular piston includes a pre-swirler to produce a swirl motion of the air passing through to the rotor disk in the direction of the rotor disk rotation.

17. The gas turbine engine of claim 16, and further comprising:

The pre-swirler is formed by a plurality of vanes formed within a central passage of the annular piston.

* * * * *